United States Patent [19]

Back

[11] Patent Number: 4,553,372

[45] Date of Patent: Nov. 19, 1985

[54] PLANT FOR WRAPPING THE ENVELOPE SURFACE OF A PREFERABLY CYLINDRICAL ARTICLE

[75] Inventor: Karl J. Back, Upplands Väsby, Sweden

[73] Assignee: Stretch Emballering AB, Upplands Väsby, Sweden

[21] Appl. No.: 541,234

[22] Filed: Oct. 12, 1983

[30] Foreign Application Priority Data

Oct. 20, 1982 [SE] Sweden ..... 8205968

[51] Int. Cl.[4] ..... B65B 11/56; B65B 53/00

[52] U.S. Cl. ..... 53/411; 53/214; 53/211; 53/587

[58] Field of Search ..... 53/131, 211, 214, 399, 53/441, 411, 586, 587

[56] References Cited

U.S. PATENT DOCUMENTS

| | | | |
|---|---|---|---|
| 2,092,066 | 9/1937 | Haupt | 53/211 X |
| 2,893,189 | 7/1959 | Lancaster | 53/587 |
| 2,893,191 | 7/1959 | Lancaster | 53/214 X |
| 3,290,861 | 12/1966 | Prager | 53/214 |
| 3,662,511 | 5/1972 | Eliasberg | 53/411 |
| 3,678,646 | 7/1972 | Clark | 53/214 X |
| 3,715,864 | 2/1973 | Odelberg | 53/211 |
| 4,341,586 | 7/1982 | Koutonen | 53/211 X |
| 4,362,001 | 12/1982 | Cockerham, Jr. et al. | 53/211 X |

*Primary Examiner*—Paul A. Ball

*Attorney, Agent, or Firm*—Burns, Doane, Swecker & Mathis

[57] ABSTRACT

A plant for wrapping a cylindrical article includes means (6,7) for carrying and rotating the article relative a supply (1) for a web (71) of wrapping material, means (5,6,10,17) for applying the end of the material web (71) to the article, and parting means (2,29,22) for parting the web (7) at the termination of a wrapping operation. An endless belt (5) runs over two end pulleys (6,10) and is in contact with the envelope surface of the article at a first end pulley (6) of the belt. The other end pulley (10) is arranged at a distance from the article. The supply unit (1) is arranged to carry the web-like material (71) in the form of a coil (8) and includes a clamp roll (17) for the material web, said roll being movable to and from the belt (5) and normally disposed at a distance from the belt. The parting means includes a knife (29) situated between the clamp roll (17) and the first end pulley (6) of the belt at a distance above the part of the belt (5) and facing towards the web (71).

20 Claims, 5 Drawing Figures

PLANT FOR WRAPPING THE ENVELOPE SURFACE OF A PREFERABLY CYLINDRICAL ARTICLE

TECHNICAL FIELD

Figure 1:
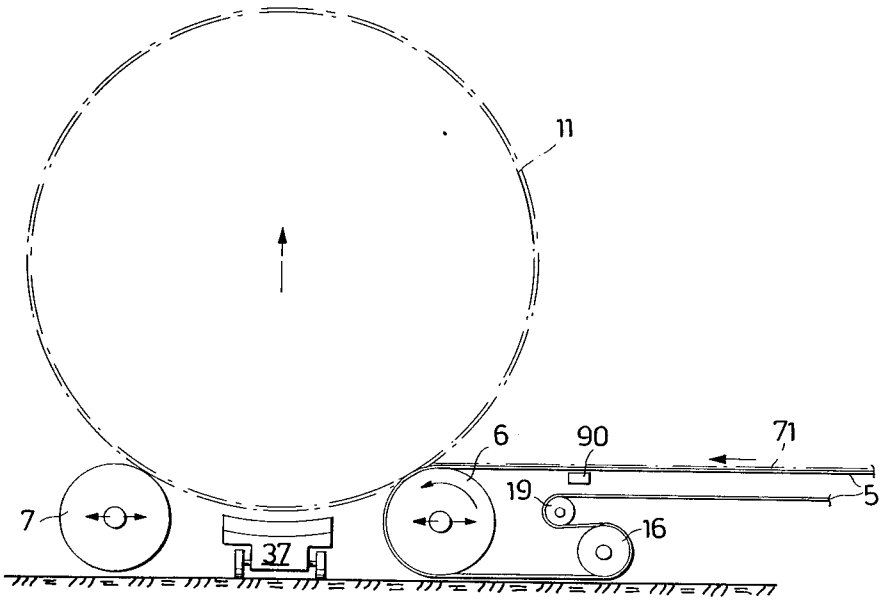

The invention relates to a plant for wrapping a preferably cylindrical article, including means for rotating the article relative a supply of a web of wrapping material, for winding the web about the envelope surface of the article, means for applying the end of the web to the article, means for keeping the web stretched during winding and means for separating the web at the termination of a wrapping operation.

BACKGROUND

In plants of the kind indicated above, it is a desire to automate the attachement of the forward end of the material web to the article. A further desire in such a plant in which the material supply contains the web in the form of a coil of material, is to easily introduce a new coil of material and connect its end to the terminal end of the previous material web in the supply. Further desires are to provide a plant including a plurality of supply units with their material webs partially overlapping each other so that the effective wrapping width achieved by the plant can be easily suited to the axial length of the article series in question. A still further desire is to provide a plant of the last-mentioned kind in which the supply units are mutually displaceable for providing optional overlapping between their webs for suiting the total wrapping width to the axial length of the article.

The aforementioned desires have previously not found their solution. One object of the invention is therefore, inter alia, to provide a plant affording a solution for the desires mentioned and also permitting simple identification marking of the wrapped article when the wrapping material is transparent and preferably comprising stretch film. Further objects of the invention will be seen from the following.

CHARACTERIZATION OF THE INVENTION

The invention is based on a plant for wrapping the envelope surface of a preferably cylindrical article, and includes means for rotating the article relative a supply of a web of wrapping material for winding the web around the envelope surface of the article, means for applying the end of the web to the article, means for keeping the web stretched during winding and means for separating the web at the termination of a wrapping operation. The plant is mainly distinguished in that an endless conveyor belt is arranged to run over two end rolls or pulleys, the belt being in contact with the envelope surface of the article at one first end roll; in that the second roll is disposed spaced from the article; in that the supply unit is arranged to carry the web-like material in the form of a coil in a manner known per se; in that the supply unit includes a pressure roll movable to, and away from the belt, said roll normally being disposed spaced from the belt; and in that the web scoring means of the separating means is disposed between the pressure roll and the first end pulley of the belt at a distance above the belt part facing towards the web. The pressure roll can be adapted such that it is lowered to clamp the forward end part of the material web after separation, for allowing withdrawal of the web from the supply and advancing it with the aid of the belt to the nip between the belt and a new article brought into the plant. The web may be parted by being partially slit or scored by the scoring means, while the web tensioning means is inactivated. The scored zone of the web is allowed to move to a point between the scoring means and the first end roll or pulley, whereupon the web tensioning means is once again activated so that the arresting force in the web exceeds the strength in the scored zone of the web. Rotation of the article can be continued so that the separated end of the web is wound up on the envelope surface of the article. A heating means may be arranged to heat the belt so that it welds the web end against underlying turns, if the web consists of a heat-weldable material. Glue spraying means may also be assigned to the supply for applying glue to either side of the web scoring zone. The glue spraying means may also be adapted for acting on the web between the first end roll and the slitting means. The supply can also be provided with an ink jet writer for applying identification marking on the "inside" of the material web if the web is of transparent material.

The ink jet writer is to advantage arranged above the web between the scoring means and the first end roll, where the web is kept stretched with the aid of the web tensioning means and is thus kept at a constant level, so that the writer can apply clear and easily-read markings on the web.

The web tensioning means can include one or more web braking rolls arranged in the supply unit between the roll of material web and the clamp roll. The arrestable rolls can to advantage be provided with electromagnetic braking means, which can thus be simply energized or unenergized to allow the aforementioned parting of the web. The supply unit may include two parallel, spaced support rolls on which the material web coil is carried, the web running down between these rolls.

The ink writer can be arranged to bring the information on the terminal part of the article wrapping material web, and also to repeat the information at a spacing which is less than $\frac{1}{3}$ of the article periphery. Furthermore, means for rotating the article can be connected to a weighing device controlling the writer such as to give the weight of the article.

The plant may further include a detector adapted for detecting a detectable marking on the web at its terminal end, such as to generate a signal for indicating the need of material coil change.

The coil of material web is preferably wound on a core, the support rolls for the material roll having a spacing which is somewhat greater than the diameter of the core, which permits the core with the terminal portion of the web to fall down between these rolls so that a new coil of material can be placed on them for connection to the web of the preceding material coil. The plant includes to advantage a plurality of supply units, each with its associated endless belt. The belts being arranged substantially parallel and in a common plane, the neighboring supply units in the axial direction of the article being arranged at different distances from the common first end roll or pulley. The supply units in such a case are preferably mutually axially displaceable and fixable in selected spacing to allow suiting their total web covering width to the axial length of the article. Furthermore, the accordingly mutually positionally adjusted supply units may be commonly displaceable in the axial direction of the article for accompanying the article in its axial direction if the article is carried on two parallel support rolls, and the article is somewhat conical so that it tends to wander along its support rolls.

The supply units do not, of course, need to be unitized to a greater extent than is justified by the axial length of an article.

The invention is defined in the appended claims.

The invention will now be described in detail with the aid on an embodiment and with reference to the accompanying drawing.

DRAWING

Figure 2:
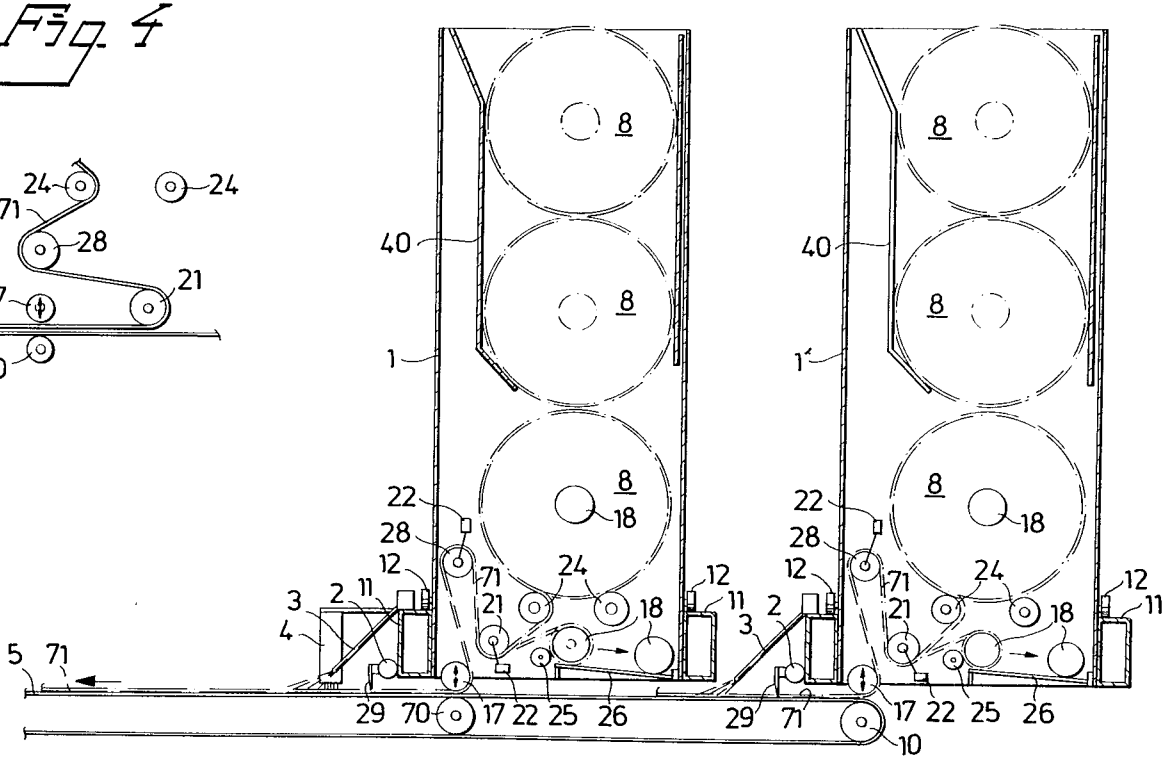
Figure 4:
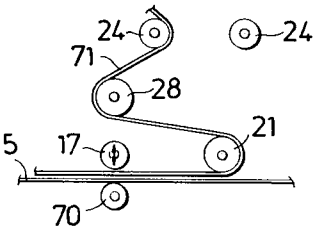
Figures 3, 5:
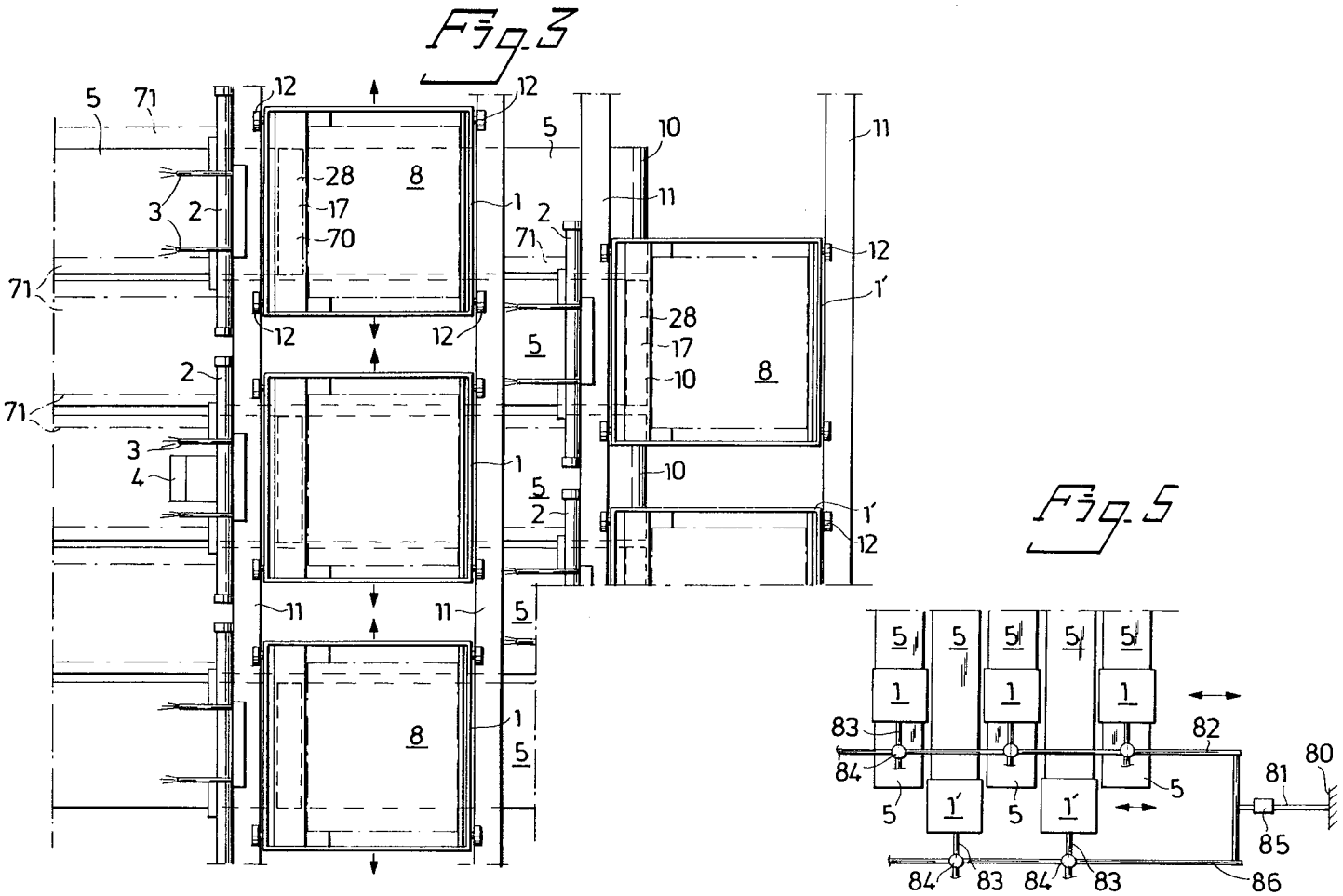

FIG. 1 schematically illustrates an end view of a cylindrical article which is to be wrapped, and which is carried for rotation in a part of the inventive plant. FIG. 2 is a side view of the supply portion of the plant in accordance with the invention. FIG. 3 is a schematic, horizontal view of the plant according to FIG. 2. FIG. 4 schematically illustrates an alternative to the web training illustrated in the supply unit according to FIG. 2. FIG. 5 schematically illustrates how a plurality of supply units in an inventive plant may be mutually adjustable and fixable.

EMBODIMENT EXAMPLE

A paper roll or article 11 is illustrated in FIG. 1, and the envelope surface of this article is to be wound with a material web 71, preferably consisting of stretch film. The article 11 is carried on two parallel rolls 6, 7 from and respectively to a conveyor 37 for article 11, said conveyor 37 being placed between rolls 6, 7 and extending parallel to them. One roll 6 is the end pulley for an endless belt 5, the under part of which runs over two snub pulleys 16 and 19, the pulley 16 being fixed relative the roll 6 so that the belt is in tension even when the roll 6 is displaced parallel to itself. The article 11 thus rests on the roll 6 via the belt 5. It will be seen in FIG. 2 that the belt 5 also runs over a second end pulley 10. At least one of the rolls 6, 7 for the article 11 is driven for rotation of article 11.

To the right in FIG. 2 there is shown a supply unit 1 for the wrapping material web 71, which is arranged in the form of coils 8 and preferably consists of stretch film. The supply unit 1 contains two support rollers 24 on which a coil 8 is carried, the stretch film 71 passing down between the rollers 24 to run round an arrestable roller 21 and then round the major part of an arrestable roller 28 and round a raisable and lowerable clamping roller 17, from which the stretch film web 71 runs practically parallel to the upper part of the belt 5 up to the nip between the article 11 and the pulley 6, such that the web 71 is wound up onto the envelope surface of the article 11 in a stretched condition by braking with the aid of the rollers 18, 21. Regulatable brakes are used to control the braking of rollers 18, 21. These brakes may be coaxial with the rollers 18, 21 and of electromagnetic type, so that the braking force they exert may be easily adjusted and so that they can be easily energized and de-energized.

The coils 8 are wound up onto cores 18. The distance between the support rollers 24 is somewhat greater than the diameter of the core 18. When a coil 8 approaches its termination it will thus fall down between the rollers 24 to a sloping ramp 26 from which the core 18 can roll away. A stop roller 25 prevents the core from rolling to the left in FIG. 2 while the web 71 is being unwound from the core 18 on the ramp.

The stretch film is preferably provided with a detectable marking in the area of its terminal end, said marking being detectable by detector means indicating the need of a new coil 8. Such a new coil 8 can be fetched from a coil magazine 40 in the supply unit 1 and quite simply set down on the support rollers 24, since the previous coil 8 has fallen down between these to the ramp 26. The web end of the new coil 8 can be attached to an underlying turn with the aid of a relatively weakly adhesive glue spot, the web end being released from the coil and adhered by the glue spot to the material web 71 extending from the core 18 on the ramp 26, subsequent to which the winding operation can be continued.

The clamp roll 17 is normally kept raised from the upper part of the belt 5 and disposed in a position substantially immediately above a support pulley 70 for the belt, or immediately above the other end pulley 10 for the belt 5 (see the supply unit 1' in FIG. 2). The stretch film web 71 will accordingly run separate from the belt 5 right up to the nip between the coil 11 and the roller or pulley 6.

When the coil 11 begins to become ready-wrapped, a power cylinder 2 carrying a knife is activated to score the web 71 between the pulley 6 and pulley 70 or end pulley 10. The cylinder 2 is parallel with, and extends transverse to, the web 71 above the upper part of the belt 5, and does not need to drive the knife 29 over the whole of the width of the web 71 or through the whole of its thickness, since the pulling force in the web 71 is so great (due to the brakes acting on the rollers 21, 28) that a partial slit or scoring of the web 71 results in parting it.

Parting the web 71 is done by the brakes of the rollers 21, 28 being de-energized, the knife 29 being caused to score the web 7, and the scoring zone is allowed to move (by rotation of the coil 11) along the belt 5 to a point between the knife 29 and pulley 6, subsequent to which the brakes are activated, whereby the web 7 is parted at the site of the score. During continued rotation of the coil 11, the terminal end of the web 7 is wound up onto the coil 11 while the forward part of the web 7 on the belt 5 remains stationary, since no substantial pulling force is excercised by the belt 5 against the forward end of the web 71.

As will be seen in FIG. 1, a heating means 90 can be arranged to heat the belt 5 for welding the terminal end of the web 71 to the article 11, if the web comprises a heat-weldable material such as stretch film. It should be noted that the supply unit 1 also includes a glue spraying means 3 adapted for spraying a coating of glue onto the web 71 on either side of the scored side to ensure the rear end of the web 71 adhering to underlying turns on the article 11 or to the article 11 itself.

When the ready-wrapped coil 11 is replaced with a new coil to be wrapped, the clamp roll 17 is lowered and clamps the web 71 to the belt 5 so that the web accompanies the belt 5 into contact and attachment against the coil 11 at the nip between the coil and belt 5, (possibly while the brakes of the rollers 21, 28 are kept de-energized), subsequent to which the clamp roll 17 may be raised and the sequence repeated while braking the web 71 with the aid of the rollers 21, 28.

Alternatively, parting of the web 71 may be achieved by the web being cut with the aid of the knife 29.

Advance of the forward end of the web 71 can then take place by its accompanying the belt 5, the clamp roll 17 being kept in its lowered position. This roll should then be implemented such as to prevent the web 71 being rolled up on it, and its surface should thus be formed with low friction to avoid this rolling-on phenomenon. As a further measure, the envelope surface of the roll 17 may be perforated and the inside of it connected to a compressed air source, so that air is blown out through the perforations, thereby preventing the web 71 from being rolled up onto the roll.

In FIG. 4 there is illustrated alternative training of the web 71 in conjunction to the supply unit 1. In this case the arrestable roller 21 is arranged at a lower level than the clamp roll 17 in its upper position so that the web 71 normally runs free from the clamp roll 17.

On its side facing towards the roll 11 the supply unit 1 carries glue spraying means 3, consisting of a glue store with a spray jet arranged to apply glue spots to the terminating and starting ends of the web 71, i.e. on either side of the knife slit or score, for facilitating attachment of the web ends to the coil 11. In the case where the web 71 consists of plastic material such as polyethylene, the heating means 90 will be preferable as an agent for providing attachment of the forward and rear ends of the web 71 to the article 11. The belt 5 should preferably be coated with teflon on its outer surface and otherwise consist of heat resistant material for allowing the heat source 90 to heat the belt 5 to a temperature of about 240° C. to provide said adhesion.

As will be further seen from FIG. 2, the supply unit 1 is provided with an ink jet writer 4, which applies product marking on the inside of the terminal portion of the transparent film web 71. The writer 4 is arranged to apply marking at intervals which are less than $\frac{1}{3}$ of the periphery of the roll 11 and to apply marking in reversed writing so that it will be readable through the stretch film on the roll 11. The markings will thus be protected by the stretch film and be repeated at least three times round the periphery of the roll 11. The pulleys 6, 7 may be connected to an unillustrated weighing machine, which gives a signal to the writer such that the latter can write the weight of the roll 11 in the marking.

The web 71 has been described above as a transparent stretch film, but it should be quite clear that any other transparent material may be used, and that the ink jet writer 4 can be replaced with a label supplying apparatus, depositing labels with the information facing towards the upper side of the film 71 in FIG. 2.

It should also be clear that the web 71 may consist of any kind of suitable wrapping material, e.g. paper, which does not need to be transparent, in which case the marking is applied on top of the wrapping material applied to the envelope surface of the coil 11.

A plurality of supply units 1, 1' is illustrated in FIGS. 2 and 3, these being arranged staggered, each supply unit being assigned a belt 5 running over the common pulley 6. Similarly, the belts 5 run over rear end pulleys 10 coaxial and parallel to the pulley 6. The belts 5 are disposed substantially parallel in a common plane, neighboring units being displaced in the manner apparent from FIG. 3, only one of the units (e.g. a contral unit) need to be provided with a writer 4. The supply units 1, 1' may be displaceable on wheels 12 along beams 11, so that overlapping between their webs 71 can be set in a desired manner.

As will be seen from FIG. 5, the supply unit 1 in the forward end of the unit has rods 83 with locking means 84 coacting with a rod 82, such that the units 1 may be fixed into desired mutually spaced positions on the rod 82. The rod 82 may be rigidly attached to a rod 86 parallel thereto. The supply units 1' may have rods 83 with locking means 84 permitting optional positioning of the supply units 1' relative the rod 86.

It will thus be understood that the supply units 1, 1' can be displaced to optional mutually spaced positions in the axial direction of the roll 11. The thus mutually, relatively fixed supply units 1, 1' can be axially displaced by a telescopic locking means 85 which is carried with the aid of a schematically illustrated strut 81 from a fixed point 80. The lastmentioned mechanism allows displacement of all supply units 1, 1' so that the webs 71 may accompany a coil 11 if it wanders along the pulleys 6, 7 due to its being somewhat conical.

Above it has been suggested to have a separate belt 5 and a separate second pulley 10 for each supply unit, but that is for practical reasons only, and it should be noted that a wide single belt can be used instead of a plurality of, or all supply units of an inventive plant, and that a single second pulley can be used for the single wide belt or for a plurality of or all the separate belts.

The part of the belt or belts 5 that supports the web 71 between the clamping roll 17 and the pulley 6 during one operation condition of the plant, is arranged generally and preferably substantially horizontal, in order that feed of a forward free web end from the clamping roll 17 to the article shall be proper without risks for wrinkles in said web end portion.

I claim:

1. A plant for wrapping a preferably cylindrical article, including means for rotating the article relative to a supply of a web of wrapping material, means for winding the web about the article, means for applying an end of the material web to the article, means for keeping the web stretched during winding about the article, and means for parting the web at the end of a wrapping operation, comprising an endless belt arranged to run over two end pulleys and to lie in contact with a surface of the article, at a first end pulley with the other end pulley spaced from the article, the supply being arranged to carry the web-like material in the form of a coil, the supply including a roll movable away from and towards the belt for clamping the material web against the belt so that the web accompanies the belt, the web supporting portion of the belt extending substantially horizontally between the clamping roll and the article, said clamping roll normally being disposed spaced from the belt, the parting means including a slitting means disposed between the clamping roll and a zone of contact of the belt with the article and at a distance above a part of the belt facing towards the web.

2. Plant as claimed in claim 1, characterized in that the supply unit (1) is provided with an ink jet writer (4) adapted for applying information to the web (71) in the portion thereof between the clamp roll (17) and article (11), the writer (4) being adapted to apply the information at the terminal portion of the wrapping material web (71) of the article (11) and to repeat the information at spacing less than $\frac{1}{3}$ of the periphery of the article (11), the writer preferably being adapted to receive signals from a weighing machine connected to the support menas (6, 7) of the article (11), whereby the weight indications of said machine may thus be included in said information.

3. Plant as claimed in claim 1, characterized in that the coil (8) of the material web is wound onto a core (18), and in that the support rollers (24) of the coil (8) have a spacing which is somewhat greater than the diameter of the core (18) to allow the core with the terminal portion of the web (71) to fall down between said support rollers (24) so that a new coil (8) can be placed on said rollers and connected to the terminal portion of the previous material web (71).

4. Plant as claimed in claim 1, characterized in that the clamp roll (17) is hollow and has a perforated envelope surface, the cavity of said roll (17) being connectable to a compressed air source to allow the expulsion of compressed air through the perforations of said envelope surface.

5. Plant as claimed in claim 1, characterized in that the envelope surface of the clamp roll (17) is made from material having high slipping capacity in relation to the material web (7), and in that the parting means includes, in addition to scoring means (29) arranged for partially parting the material web (71), said braking means (22) for the arrestable rollers (21, 28) and means for energizing and de-energizing the braking means (22) after partial slitting or scoring of the material web (71) so that the web is parted at the scoring zone by energizing the braking means (22) when the scoring zone is between the scoring means (29) and said first end pulley (6) of the belt (5).

6. Plant as claimed in claim 1, characterized in that the belt (5) comprises a temperature-resistant material and that heating means (90) are arranged under the web (71)-supporting part of the belt (5) for allowing adhesion of the web (71) to underlying winding turns on the article (11).

7. Plant as claimed in claim 1, characterized in that a plurality of supply units (1, 1'), each with its associated endless belt (5), is arranged with the belts (5) substantially parallel and in a common plane, neighboring units (1) being disposed at different distances from the common first belt end pulley (6), the other end pulleys (10) of the belts (5) being coaxially arranged and parallel to the first end pulley, and that the supply units are displaceable in a direction parallel to the end pulley (10) of the belt (5) for establishing varying overlapping between the material webs (71) of the supply units (1, 1').

8. Plant as claimed in claim 7, characterized by means (83, 84, 82, 86) for optional adjustment of the mutual axial spacing of the supply units (1, 1'), and means (80, 81, 85) for adjusting the axial positions of the mutually relatively fixed supply units (1, 1') relative the support rolls or pulleys (6, 7) of the article (11), the other end pulleys (10) of the belts (5) being arranged fixed.

9. Plant as claimed in claim 1, characterized in that the zone of contact of the belt (5) with the article (11) is formed by the first end pulley (6) of the belt, this pulley together with a roll parallel thereto forming support means for the article (11), one of the carrying rolls or pulleys (6, 7) being driven for rotation to form said means (6, 7) for rotating the article.

10. Plant as claimed in claim 9, characterized in that the supply unit (1) includes two parallel spaced support rolls (24) on which the coil (8) of the material web is carried, the web (71) being arranged to run between the support rolls (24) of the coil (8) and partially round one or more attestable rollers (21, 28) provided with regulatable braking means (22) and then about the clamp roll (17).

11. Plant as claimed in claim 9, characterized in that the supply unit (1) is provided with an ink jet writer (4) adapted for applying information to the web (71) in the portion thereof between the clamp roll (17) and article (11), the writer (4) being adapted to apply the information at the terminal portion of the wrapping material web (71) of the article (11) and to repeat the information at spacing less than $\frac{1}{3}$ of the periphery of the article (11), the writer preferably being adapted to receive signals from a weighing machine connected to the support means (6, 7) of the article (11), whereby the weight indications of said machine may thus be included in said information.

12. Plant as claimed in claim 9, characterized in that the coil (8) of the material web is wound onto a core (18), and in that the support rollers (24) of the coil (8) have a spacing which is somewhat greater than the diameter of the core (18) to allow the core with the terminal portion of the web (71) to fall down between said support rollers (24) so that a new coil (8) can be placed on said rollers and connected to the terminal portion of the previous material web (71).

13. Plant as claimed in claim 9, characterized in that the clamp roll (17) is hollow and has a perforated envelope surface, the cavity of said roll (17) being connectable to a compressed air source to allow the expulsion of compressed air through the perforations of said envelope surface.

14. Plant as claimed in claim 9, characterized in that the envelope surface of the clamp roll (17) is made from material having high slipping capacity in relation to the material web (7), and in that the parting means includes, in addition to scoring means (29) arranged for partially parting the material web (71), said braking means (22) for the arrestable rollers (21, 28) and means for energizing and de-energizing the braking means (22) after partial slitting or scoring of the material web (71) so that the web is parted at the scoring zone by energizing the braking means (22) when the scoring zone is between the scoring means (29) and said first end pulley (6) of the belt (5).

15. Plant as claimed in claim 9, characterized in that the belt (5) comprises a temperature-resistant material and that heating means (90) are arranged under the web (71)-supporting part of the belt (5) for allowing adhesion of the web (71) to underlying winding turns on the article (11).

16. Plant as claimed in claim 9, characterized in that a plurality of supply units (1, 1'), each with its associated endless belt (5), is arranged with the belts (5) substantially parallel and in a common plane, neighboring units (1) being disposed at different distances from the common first belt end pulley (6), the other end pulleys (10) of the belts (5) being coaxially arranged and parallel to the first end pulley, and the supply units are displaceable in a direction parallel to the end pulley (10) of the belt (5) for establishing varying overlapping between the material webs (71) of the supply units (1, 1').

17. Plant as claimed in claim 1, characterized in that the supply unit (1) includes two parallel spaced support rolls (24) on which the coil (8) of material web is carried, the web (71) being arranged to run between the support rolls (24) of the coil (8) and partially round one or more arrestable rollers (21, 28) provided with regulatable braking means (22) and then about the clamp roll (17).

18. Plant as claimed in claim 17, characterized in that the supply unit (1) is provided with an ink jet writer (4) adapted for applying information to the web (71) in the portion thereof between the clamp roll (17) and article (11), the writer (4) being adapted to apply the information at the terminal portion of the wrapping material web (71) of the article (11) and to repeat the information at spacing less than $\frac{1}{3}$ of the periphery of the article (11), the writer preferably being adapted to receive signals from a weighing machine connected to the support means (6, 7) of the article (11), whereby the weight indications of said machine may thus be included in said information.

19. Plant as claimed in claim 17, characterized in that the coil (8) of the material web is wound onto a core (18), and in that the support rollers (24) of the coil (8) have a spacing which is somewhat greater than the diameter of the core (18) to allow the core with the terminal portion of the web (71) to fall down between said support rollers (24) so that a new coil (8) can be placed on said rollers and connected to the terminal portion of the previous material web (71).

20. Plant as claimed in claim 17, characterized in that the clamp roll (17) is hollow and has a perforated envelope surface, the cavity of said roll (17) being connectable to a compressed air source to allow the expulsion of compressed air through the perforations of said envelope surface.

* * * * *